US005365898A

United States Patent [19]

Mueller

[11] Patent Number: 5,365,898

[45] Date of Patent: Nov. 22, 1994

[54] DEVICE FOR CHANGING A ROTATIONAL POSITION OF A CONTROL SHAFT THAT CONTROLS GAS EXCHANGE VALVES OF AN INTERNAL COMBUSTION ENGINE

[75] Inventor: Martin Mueller, Moeglingen, Germany

[73] Assignee: Robert Bosch GmbH, Stuttgart, Germany

[21] Appl. No.: 201,959

[22] Filed: Feb. 25, 1994

[30] Foreign Application Priority Data

Apr. 6, 1993 [DE] Germany ..... 4311264

[51] Int. Cl.[5] ..... F01L 1/34

[52] U.S. Cl. ..... 123/90.17; 123/90.31; 74/568 R; 464/2

[58] Field of Search ..... 123/90.15, 90.17, 90.31; 464/1, 2, 160; 74/568 R, 567

[56] References Cited

U.S. PATENT DOCUMENTS 3,978,829 9/1976 Takahashi et al. ..... 123/90.17
4,463,712 8/1984 Stojek et al. ..... 123/90.17
4,494,495 1/1985 Nakamura et al. ..... 123/90.17
4,494,496 1/1985 Nakamura et al. ..... 123/90.17
4,498,431 2/1985 Nakamura et al. ..... 123/90.17
4,561,390 12/1985 Nakamura et al. ..... 123/90.17

*Primary Examiner*—E. Rollins Cross
*Assistant Examiner*—Weilun Lo
*Attorney, Agent, or Firm*—Edwin E. Greigg; Ronald E. Greigg

[57] ABSTRACT

A device for changing the rotational position of a rotating, driven control shaft that controls the opening and closing of gas exchange valves of an internal combustion engine and is displaced via an electric motor and an interposed toggle lever arrangement having a downstream diagonal toothing arrangement for simplified displacement with minimal force and energy expenditures. The result is a simple, accessible, easy to maintain economical displacement drive for changing the rotational position of the control shaft in order to change the control times of gas-exchange valves in an internal combustion engine.

20 Claims, 2 Drawing Sheets

DEVICE FOR CHANGING A ROTATIONAL POSITION OF A CONTROL SHAFT THAT CONTROLS GAS EXCHANGE VALVES OF AN INTERNAL COMBUSTION ENGINE

The invention is based on a device for changing a rotational position, as defined hereinafter.

BACKGROUND OF THE INVENTION

In such a device, which is known from German Patent Disclosure DE-A1 31 46 613, a driving toothed wheel for driving two control shafts disposed parallel to one another is provided for each shaft. These driving toothed wheels have a parallel diagonal teeth with which the wheels engage a corresponding parallel, diagonal front toothing of a transmission element. This element is embodied as a toothed wheel having a hub whose bore has a spline shaft toothing on the casing surface, the toothing being slid on an outer spline shaft toothing of the end of the control shaft and axially displaceable there without torsion. For displacing the transmission element, the element is coupled with a sleeve having a rack-and-pinion toothing at its outer circumference that is engaged by a corresponding pinion of an adjusting shaft, which in turn is coupled with an electric motor via a worm gearing. The toothed wheel of the transmission element in this instance is embodied to be essentially wider than the driving toothed wheel so that the element remains in engagement with the driving toothed wheel, despite being longitudinally displaced on the spline shaft end of the control shaft. During this displacement the rotational position of the transmission element, together with the rotational position of the control shaft, changes with respect to the rotational position of the driving toothed wheel.

This device requires an electric motor for each control shaft. This makes the device for changing a rotational position very costly to construct, and requires a drive that is integrated into the engine block and is located between the engine block and the driving toothed wheel, which is located on the outside and driven by the crankshaft. The driving toothed wheel, and again a toothed wheel driving the driving toothed wheel, both require a diagonal toothing, so that in this case as well operation is more costly with respect to the toothed wheels to be used.

OBJECT AND SUMMARY OF THE INVENTION

In contrast, the device of the invention has the advantage that the rotational position of the control shaft can be changed in a simple manner with few transmission elements. A small electric motor having less driving power can be used in this device. In a modification in accordance with the invention, a desired transmission of force or direction can be achieved with the aid of the transmission lever, and an influence can be established on the rate of adjustment and initial position. The subject matter can be attained in a simple manner by the selection of the lever arm ratio of the two-armed lever. By means of interposing the support lever between the stationary support and the pivoting pin, a greater output adjustment variable can be achieved with respect to the input adjustment variable, in the form of the adjustment of the screw socket on the threaded spindle, and with the use of small adjustment forces.

In this case the electric motor, along with a threaded spindle, can advantageously be compact and disposed transversely to the ends of the control to be easily accessible. In an advantageous manner, a simple connection by adjustable contact that can be realized with commercial machine elements is produced between the transmission lever and the driving element. This embodiment is designed to be simple, accessible and compact, as ensues from the subject herein. In an advantageous manner, a plurality of control shafts can also be adjusted at low cost with an electric motor. In this instance, the lever transmission also has a positive effect on the power needs of the electric motor. In a further advantageous manner, a second electric motor can be provided for emergency operations; this motor is activated when the first electric motor fails. Finally, the embodiment offers the option of guiding the cam shaft back into an end position when the electric motor is turned off.

The invention will be better understood and further objects and advantages thereof will become more apparent from the ensuing detailed description of exemplary embodiments taken in conjunction with the drawing.

DETAILED DESCRIPTION OF THE PREFERRED EMBODIMENTS

Figures 1, 3:
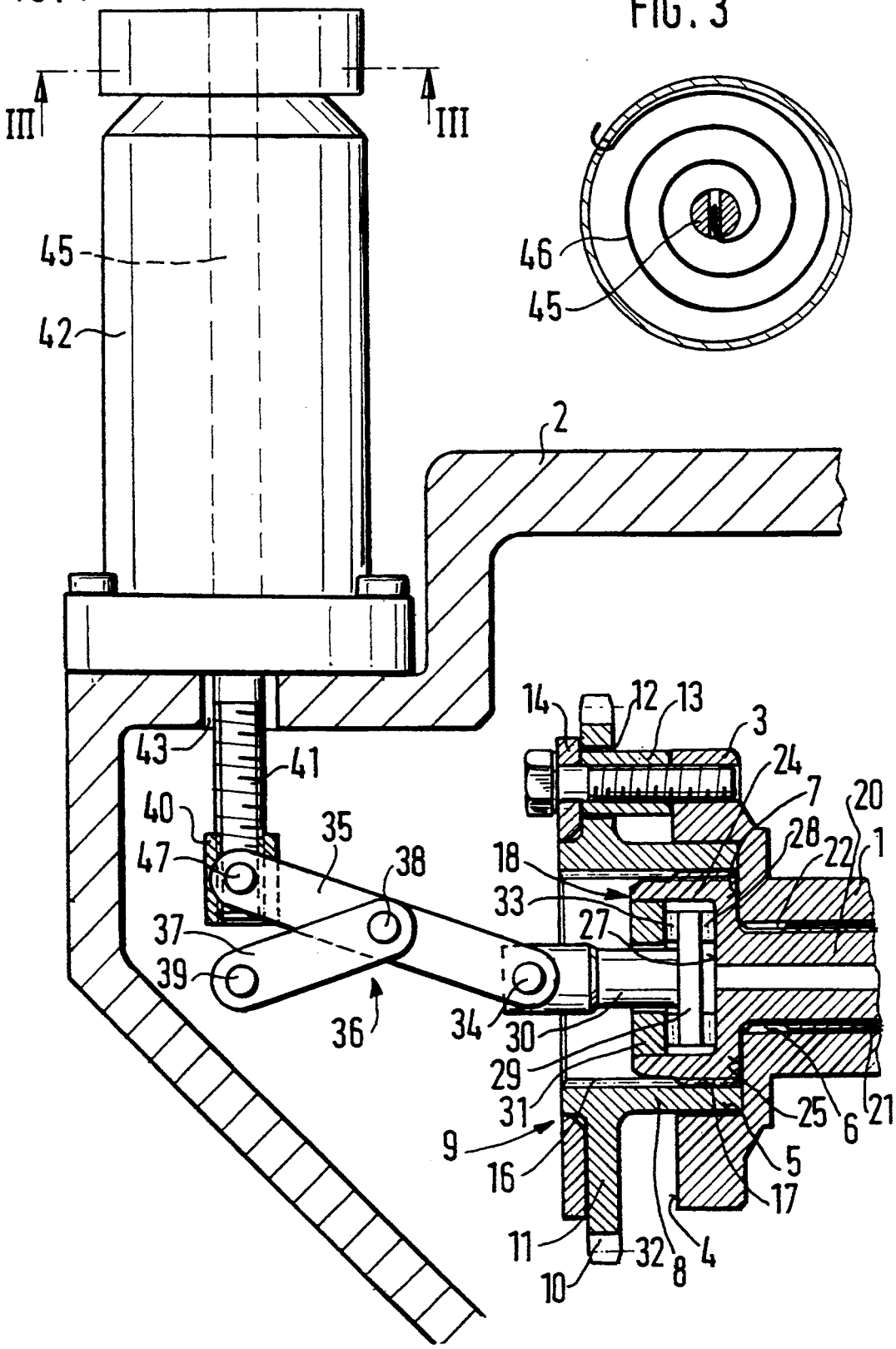
FIG. 1 shows a first exemplary embodiment that includes a device for operating a single control shaft.
FIG. 3 is a section along line III—III in FIG. 1.

The section in FIG. 1 shows the end of a control shaft, in this case a camshaft 1, of an internal combustion engine not shown in detail. By means of this camshaft, gas exchange valves of the engine are operated in a standard, known manner. The camshaft 1 is seated in housing 2 of the engine in a manner not shown in detail. For driving the camshaft, the camshaft has a front flange 3, from whose outwardly-pointing face end 4 a stepped bore 5, 6 extends coaxially to the axis of the camshaft. The part 5 of the stepped bore, which is larger in diameter and leads away directly from the face end, forms a level shoulder 7 at the transition to a part 6 of the bore, which is smaller in diameter, where a hub 8 of a driving toothed wheel 9 acting as a driving element comes into contact with the shoulder on the front side. At its circumference, the driving toothed wheel has a chain wheel 10, which engages a driving chain, not shown, during operation of the engine. The driving chain in this case is driven either directly or indirectly by the crankshaft of the associated engine, so that the driving toothed wheel rotates in synchronization with the rpm of the engine. Disposed in the disk 11 of the chain wheel are a plurality of oblong holes 12 extending in the direction of the circumference and through each of which a guide sleeve 13 extends; the guide sleeve rests on one end against the front face 4 of the front flange 3, and on the other end against a holding ring 14 after passing through the disk 11. A screw pin is pulled through this ring and the guide sleeve 13 and is screwed into the front flange 3 and serves in axially securing the driving toothed wheel, which is, however, rotatable corresponding to the oblong hole 12.

The driving toothed wheel further has an inner diagonal toothing 16 on the casing surface of the inner passage bore. This toothing engages an outer diagonal toothing 17 of a power take-off element 18. The driving element has a trunnion 20 that has an outer spline shaft toothing 21, via which the trunnion engages an inner spline shaft toothing 22 on the casing surface of the stepped bore part 6 that has the smaller diameter and is displaceable without torsion along this spline shaft toothing, axially to the camshaft 1. Contiguous to the trunnion 20, the power take-off element has a pot-shaped part 24, which has a cylindrical circumferential surface with the said outer diagonal toothing and, at its transition to the trunnion 20 having the smaller diameter, has a flat annular surface 25 with which it can come into contact with the shoulder 7 as an end stop.

The bottom 27 of the pot-shaped part is embodied as a level running surface for a needle bearing 28, on which a level plate 29 is seated in the axial direction of the camshaft. On the side remote from the camshaft, the plate 29 has a connecting trunnion 30, which is coaxial to the camshaft and extends through a central opening of a threaded ring 31 screwed into an inside thread 32 in the inside casing surface of the pot-shaped part 24. Again, a needle bearing 33 is disposed between the pot-shaped part 24 and the plate 29. By means of this arrangement, the connecting trunnion 30 is connected to the power take-off part 18 to be rotatable and with frictional lockup in the axial direction. The power take-off part 18 is now displaceable inside the hub 8 of the driving toothed wheel with the aid of the connecting part formed from the connecting trunnion 30 and the plate 29. Because the rotational position of the driving part is fixed in the spline shaft toothing 21 and 22 with respect to the camshaft 1, when the driving part is displaced, the driving toothed wheel is twisted relative to the camshaft because of the diagonal toothing. When the driving toothed wheel is held securely, the camshaft twists relative to the rotational position of its drive.

A shaft 34 is secured to the connecting trunnion in order to displace it; the end of a two-armed transmission lever 35 can pivot around this shaft. This lever is part of a toggle lever arrangement 36 comprising two lever parts, the transmission lever 35 and a one-armed support lever 37, which is seated with its one end on a pivot shaft 38 located between the lever ends of the two-armed transmission lever 35, and whose other end has a bearing 39 secured to the housing. The other end of the transmission lever 35 is pivotably seated in a bearing 47 on a screw socket 40 disposed on a threaded spindle 41 which in turn is part of an electric motor 42, as its outwardly protruding motor shaft, or is coupled to a motor shaft of the electric motor 42. The electric motor is flanged to the outside of the housing 2 of the engine and protrudes with the threaded spindle 41 through an opening 43 into the housing, with the threaded spindle lying essentially perpendicular to the axis of the camshaft. The seating of the transmission lever 35 on the screw socket 40, and the bearing 39 of the support lever 37, which are attached to the housing, are preferably disposed one behind the other and aligned in the axial direction of the threaded spindle, and are located in a common plane with the axis of the threaded spindle. Moreover, the bearing 39 is preferably also in a plane that passes through the axis of the camshaft and is perpendicular to the axis of the threaded spindle 41.

When the electric motor is driven, the screw socket 40, which is secured against rotation by the lever arrangement 36, is moved axially on the threaded spindle 41, and in the process displaces the two-armed transmission lever 35 together with the support lever 37 in such a way that a great displacement is achieved with little force because of the toggle lever principle, and transmitted onto the connecting trunnion 30. In this way a great output displacement can be produced with little displacement force and input displacement, and the relative rotational position of the camshaft to its drive can be adapted quickly. The lever arrangement is practically a double toggle lever comprising the one-armed lever 37, which forms a toggle lever together with the lever arm of the two-armed transmission lever 35 disposed between pivot axis 38 and socket 40; the one-armed lever also forms a toggle lever with the lever arm disposed between the pivot shaft 38 and the shaft 34 of the transmission lever 35.

The lever arm ratio must always be 1:1! (number 38 in the middle between 47 and 34) so that points 47 and 34 move on the spindle shaft or camshaft axis. The transmission of motion can be set by means of the initial position of the motion of the screw socket 40 within specific limits. The total length of the lever 35 has an effect on the transmission of motion.

The direction of displacement of connecting part 29, 30 can be changed by means of the initial position of the screw socket 40 to the left or, seen from the bearing 39, to the right in the top view of FIG. 1. Finally, even a reversal of the motion of the connecting part in the displacement region can be achieved when the screw socket is displaced in the displacement region, in appropriate adaptation of the lever lengths, by means of the projection of the bearing 39 from a position to the left of the bearing 39 into a position to the right of the bearing 39. The threaded spindle 41 is then correspondingly embodied to be longer than shown in FIG. 1. Thus numerous setting options result that can also be adapted to the conditions of the associated engine. To make possible the passage of the screw socket 40 through the geometrical axis of the bearing 39, support levers and transmission levers are preferably embodied in duplicate on both sides of the threaded spindle, and the support levers are seated inside the housing in trunnions inserted from the outside.

To complete the arrangement, as shown in dashed lines in FIG. 1, the motor shaft of the electric motor can be secured to the outside end of the motor shaft 45, for example, by a flat spiral spring, the other end of which is fixedly secured to the housing of the electric motor, as also shown in a top view in FIG. 3. With the aid of this flat spiral spring 46, the motor shaft 45 is prestressed such that with a lack motor ignition, with the lifting of the self-locking of the threaded spindle, the motor shaft is reversed into an initial position, thus bringing the camshaft into a desired end position. In this regard, FIG. 3 shows the position of the flat spiral spring 46 with respect to the motor shaft 45, along section III—III.

In operation, when a set, relative camshaft position must be maintained, the electric motor is partly excited in such a manner that the driving forces of the electric motor from the partial excitation maintain the balance with the sum of the reversing forces from the cam drive and flat spiral spring. In the initial end position in the retarded position, emergency service of the engine, including starting of the engine, is possible.

Figure 2:
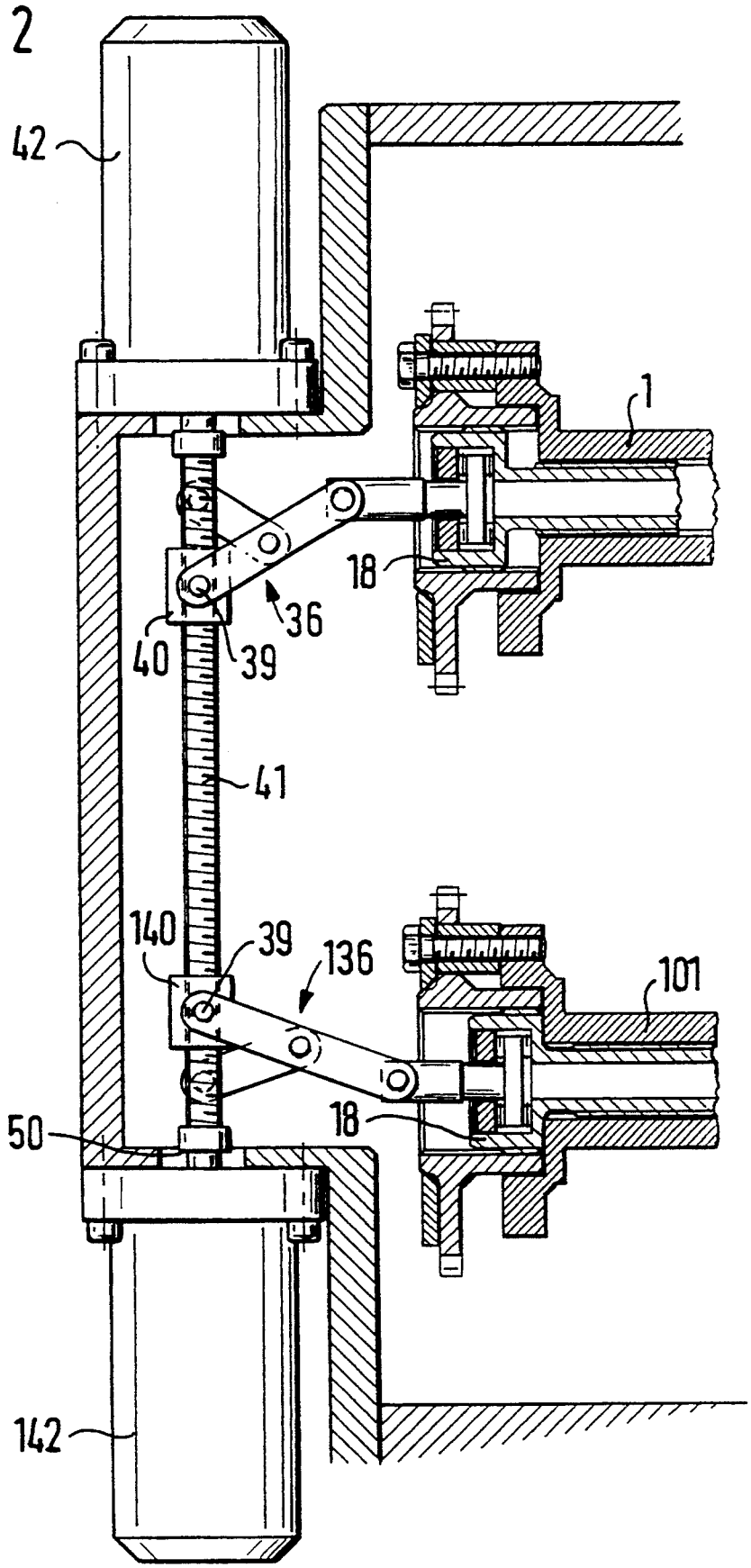
FIG. 2 shows a second exemplary embodiment for operating two parallel control shafts.

While in the exemplary embodiment of FIG. 1 only a single camshaft was displaced by means of the electric motor 42, it is possible in the embodiment of FIG. 2 to simultaneously adjust two camshafts disposed, for example, adjacent and parallel to one another. In such a case a second screw socket 140 is disposed on the threaded spindle 41, along with the screw socket 40 already shown in FIG. 1, the screw socket 140 being connected to a toggle lever arrangement 136 of the same type as toggle lever arrangement 36. By means of this arrangement, a second camshaft 101 is twisted analogously to the first camshaft 1. The threaded spindle can be seated at one end in a bearing 50 such that it is secured to the housing, which is necessary because of the length of the spindle, or it is also simultaneously connected at its seating position to a second electric motor 142, which is first currentless when the first electric motor 42 is in operation, and then serves solely in the seating of the spindle 41. However, should the operating ability of the first electric motor 42 fail for some reason, the second electric motor 42 can be used as a replacement to drive the spindle 41. In this way good operating reliability is achieved.

As can be taken from FIG. 2, the initial position of screw sockets 40 and 140 varies, that is, to the left or right of the bearing 39, so that opposed displacement motions are achieved when the electric motor is driven. Moreover, the initial position of the driving part 18 is accordingly variable with respect to the driving toothed wheel 9. The lever length of the respective lever pair 36 and 136, respectively, is selected variably so that different adjustment rates can be achieved with adaptation to the conditions of the engine. In this case as well a reversal of motion can be realized as needed.

In a simplified embodiment the camshaft adjustment is also possible with only one lever between the screw socket and the connecting part when the stationary support of the transmission lever is displaceable inside the lever, for example when it is embodied in a crank, or when the connection to the screw socket is embodied to be displaceable inside such a crank. If this is the case, the lever can also be seated stationarily at its end as a one-armed lever on which the screw socket and the connecting part engage different points. Moreover, the lever can also be embodied as a bell crank.

The foregoing relates to preferred exemplary embodiments of the invention,it being understood that other variants and embodiments thereof are possible within the spirit and scope of the invention, the latter being defined by the appended claims.

What is claimed and desired to be secured by Letters Patent of the United States is:

1. A device for changing a rotational position of a rotatable driven control shaft (1) that controls an opening and closing of gas exchange valves of an internal combustion engine with respect to a rotational position of a drive shaft that drives this control shaft, having a driving part (9) that is driven synchronously with the drive shaft and has a diagonal toothing, the driving part engages with diagonal teeth of a rotating power take-off part (18) driven synchronously with the control shaft (1), which driving part and power take-off part are adjustable relative to one another by means of a connecting part (29, 30) fixed in an axial direction to one of the parts to rotate around the axis of the one part and operated by means of an electric motor (42) controlled as a function of operating parameters, the electric motor (42) drives a threaded spindle (41) on which a screw socket (40, 140) is disposed in a manner fixed against twisting and is coupled with the connecting part (29, 30).

2. A device as defined in claim 1, in which a transmission lever (35) is disposed between the screw socket (40, 140) and connecting part (29, 30) and whose pivot axis (38) is supported against a stationary part (39), and that is connected in an articulated manner to the connecting part and the screw socket.

3. A device as defined in claim 2, in which the transmission lever (35) is embodied to have two arms.

4. A device as defined in claim 3, in which the transmission lever (35) has its pivot axis (38) between its end points, via which axis the transmission lever is coupled with a pivotable support lever (37) in a plane parallel to its pivot plane, the support lever being seated at its end in a stationary bearing (39), wherein the connecting part (29, 30) and the screw socket (40, 140) are hingedly securely coupled with the transmission lever (35).

5. A device as defined in claim 4, in which the stationary seating (39) of the support lever (37) lies essentially in an axis that is perpendicular to the spindle axis and perpendicular to the control shaft axis, and through which the point of intersection of these two axes passes.

6. A device as defined in claim 5, in which two one-armed support levers (37) and transmission levers (35) are provided that are disposed parallel to one another and on both sides of the threaded spindle.

7. A device as defined in claim 2, in which the threaded spindle (41) is disposed at a right angle to the control shaft (1).

8. A device as defined in claim 3, in which the threaded spindle (41) is disposed at a right angle to the control shaft (1).

9. A device as defined in claim 4, in which the threaded spindle (41) is disposed at a right angle to the control shaft (1).

10. A device as defined in claim 5, in which the threaded spindle (41) is disposed at a right angle to the control shaft (1).

11. A device as defined in claim 6, in which the threaded spindle (41) is disposed at a right angle to the control shaft (1).

12. A device as defined in claim 1, in which the power take-off part (18) has a trunnion (20) that has a spline shaft outer toothing (21) and displaceably engages an inside spline shaft toothing (22) of an axial bore in the control shaft (1), and that the take-off part (18) has a pot-shaped part (24) connected to the trunnion (20), at an outer circumference of said take-off part, an outer diagonal toothing (17) is provided that engages an inner diagonal toothing (16) of a driving toothed wheel (9) that forms the power take-off part and is guided to twist on the control shaft (1), said power take-off part is coupled securely with the inner diagonal toothing in the axial direction, and at its circumference has driving means (11) for a connection secure against relative rotation to a transmission means for the rotational movement of the drive shaft.

13. A device as defined in claim 12, in which a plate (29) is inserted on the front face into the interior of the pot-shaped part (24) as a connecting part, between said part and the pot bottom, on one side, and between the connecting part and a holding ring (31) attached to the pot-shaped part (24) on the other, a rolling bearing (28, 33) is respectively provided, wherein the plate has a connecting trunnion (30) that protrudes outwardly through the holding ring (31), at the end of said trunnion the end of the transmission lever (35) is pivotably secured.

14. A device as defined in claim 1, in which a plurality of control shafts (1, 101) are provided parallel to one another on the internal combustion engine, and a plurality of transmission levers associated with each control shaft is operated via the screw socket (40).

15. A device as defined in claim 2, in which plurality of parallel control shafts (1, 101) are disposed on the internal combustion engine, and a plurality of screw sockets (40, 140) corresponding to the number of control shafts and associated therewith are disposed on the threaded spindle (41),and are each connected to a transmission lever respectively associated with a control shaft.

16. A device as defined in claim 4, in which plurality of parallel control shafts (1, 101) are disposed on the internal combustion engine, and a plurality of screw sockets (40, 140) corresponding to the number of control shafts and associated therewith are disposed on the threaded spindle (41), and are each connected to a transmission lever respectively associated with a control shaft.

17. A device as defined in claim 7, in which a plurality of parallel control shafts (1, 101) are disposed on the internal combustion engine, and a plurality of screw sockets (40, 140) corresponding to the number of control shafts and associated therewith are disposed on the threaded spindle (41), and are each connected to a transmission lever respectively associated with a control shaft.

18. A device as defined in claim 13, in which the guide bearing (50) is provided at an end of the threaded spindle (41).

19. A device as defined in claim 14, in which the guide bearing is formed by a second electric motor (142) coupled with the threaded spindle.

20. A device as defined in claim 1, in which the shaft of the electric motor (42, 142) is connected to the end of a flat spiral spring (46) stationarily secured at its other end and prestressed in the direction of an end position of the screw socket (40, 140).

* * * * *